United States Patent [19]

Corey

[11] 4,382,708

[45] May 10, 1983

[54] PAPER COMPRESSOR

[75] Inventor: Joseph T. Corey, Williamsville, N.Y.

[73] Assignee: Permclip Products Corporation, Buffalo, N.Y.

[21] Appl. No.: 235,846

[22] Filed: Feb. 19, 1981

Related U.S. Application Data

[63] Continuation-in-part of Ser. No. 94,037, Nov. 13, 1979, abandoned.

[51] Int. Cl.[3] ..... B42F 13/06; B42F 13/08; B42F 13/10

[52] U.S. Cl. ..... 402/15; 402/80 P

[58] Field of Search ..... 402/14, 15, 16, 60, 402/68; 281/25 R; 24/153, 153.1; 206/347

[56] References Cited

U.S. PATENT DOCUMENTS

| | | | |
|---|---|---|---|
| 1,094,951 | 4/1914 | Washburne | 402/15 |
| 1,571,482 | 2/1926 | King | 402/15 |
| 2,292,225 | 8/1942 | Kern | 402/16 |
| 2,328,268 | 8/1943 | Gelfand | 402/15 |
| 2,329,869 | 9/1943 | Brennan | 402/17 |
| 2,339,411 | 1/1944 | Kern | 402/15 |
| 2,339,412 | 1/1944 | Kern | 402/15 |
| 2,477,417 | 7/1949 | Pitt | 402/15 |
| 2,523,922 | 9/1950 | Neuschwander | 402/16 |
| 2,536,792 | 1/1951 | Wendt | 402/15 |
| 2,876,518 | 3/1959 | Shears | 24/153 R X |
| 4,070,736 | 1/1978 | Land | 24/153.1 |

FOREIGN PATENT DOCUMENTS

| | | | |
|---|---|---|---|
| 713853 | 7/1965 | Canada | 402/80 P |

*Primary Examiner*—Paul A. Bell
*Assistant Examiner*—John S. Brown
*Attorney, Agent, or Firm*—Joseph P. Gastel

[57] ABSTRACT

A paper compressor including an elongated plastic body portion having a pair of opposite sides and a pair of opposite ends and a longitudinal axis, a slot extending inwardly from each of the ends, a hole spaced inwardly from each of the slots, a pair of ribs molded integrally with the plastic body portion and extending along the opposite sides, a central rib molded integrally with the body portion and extending along the longitudinal axis, the body portion being curved so that its undersurface is convex and its upper surface is concave. A steel paper compressor which is the same as the plastic compressor except that it does not have ribs.

15 Claims, 18 Drawing Figures

Fig. 1.
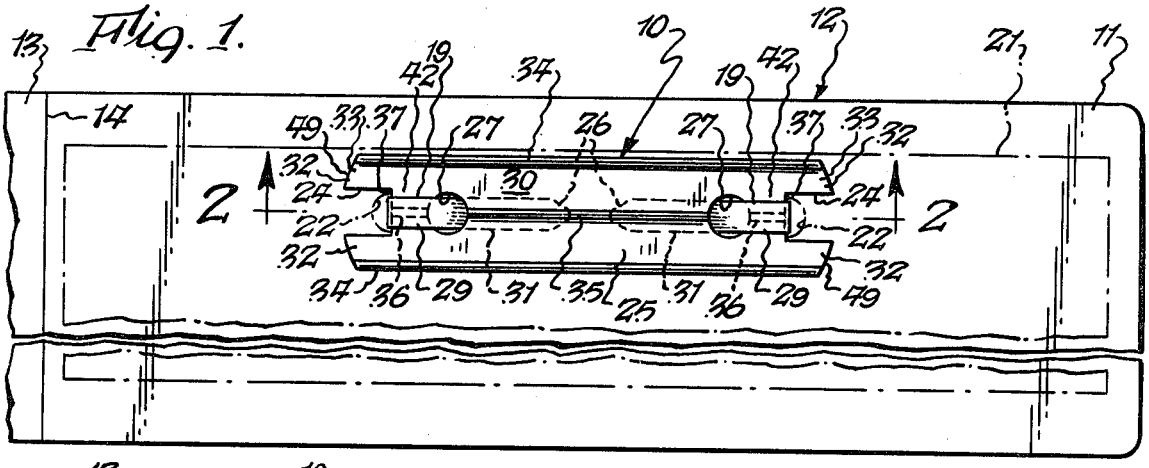
Fig. 11.
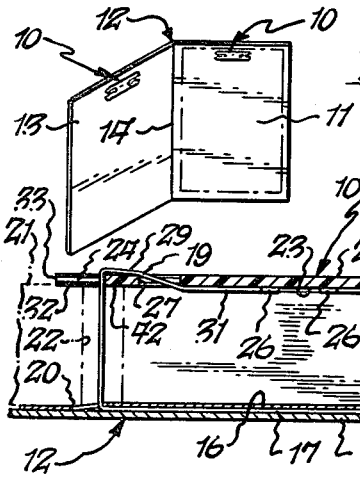
Fig. 2.
Fig. 3.
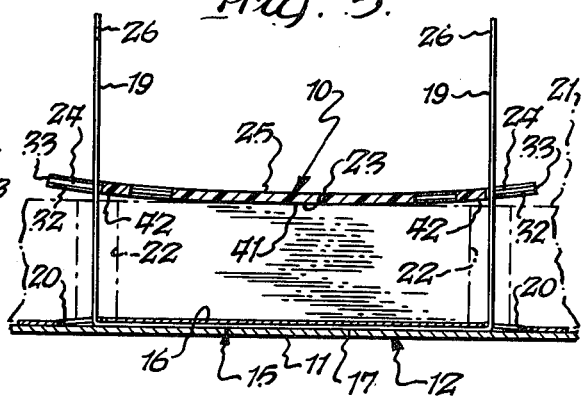
Fig. 4.
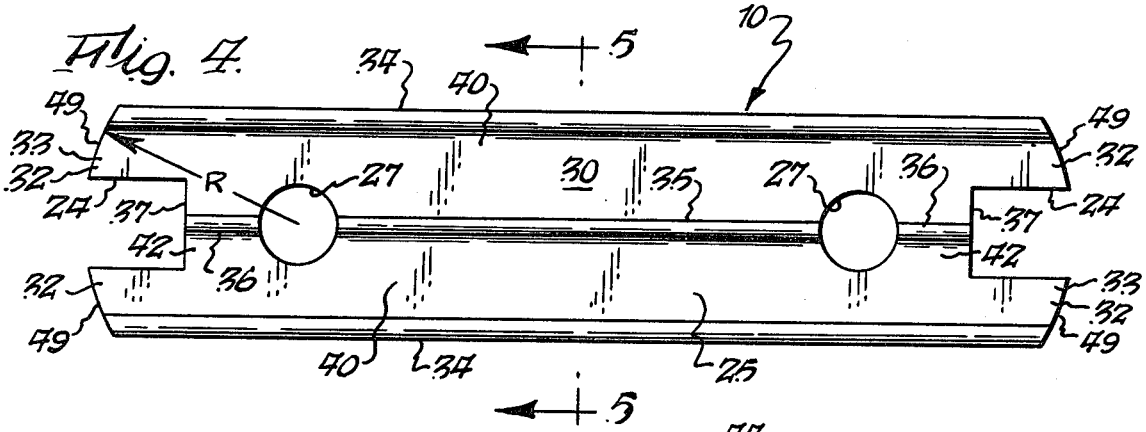
Fig. 5.
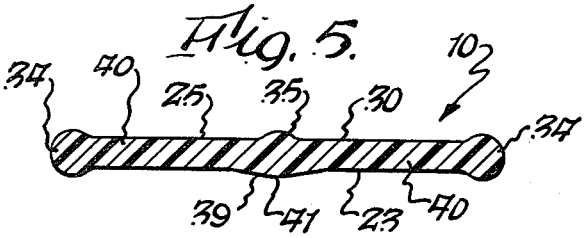
Fig. 6.
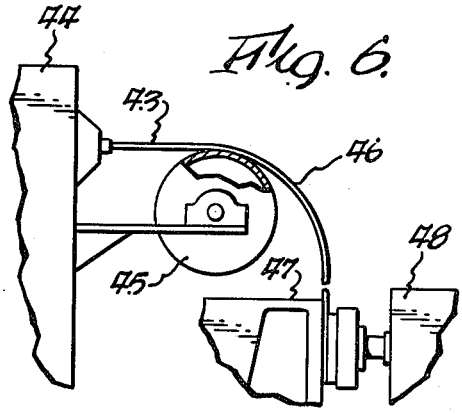

Fig. 7.
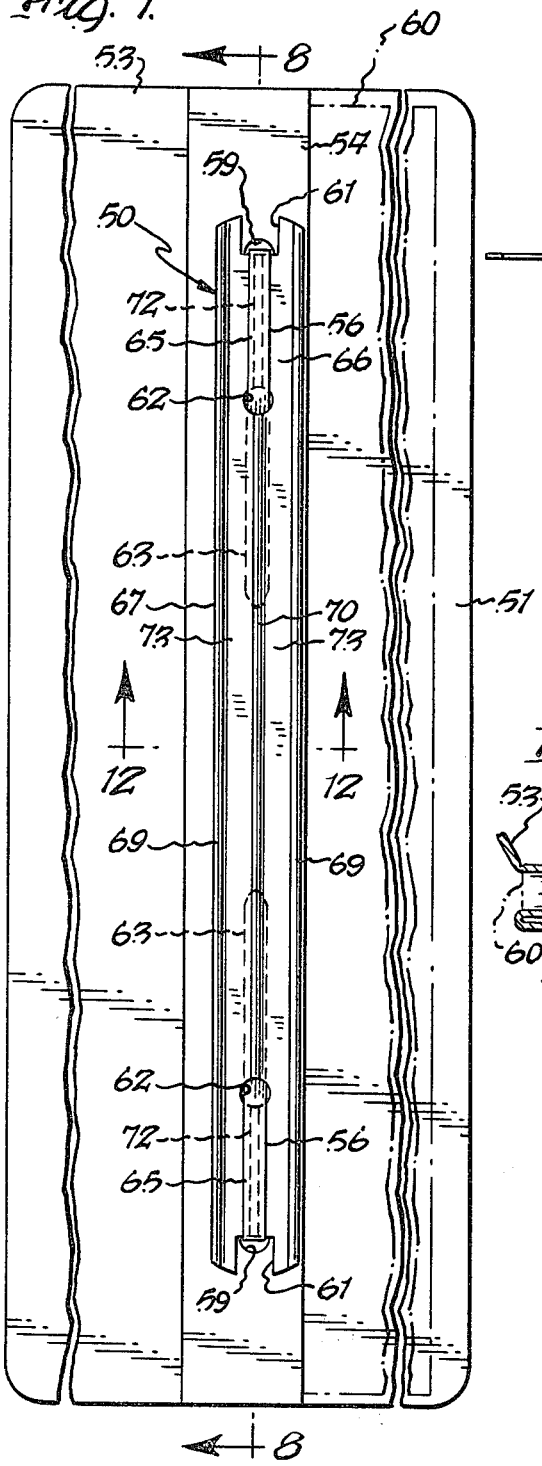
Fig. 8.
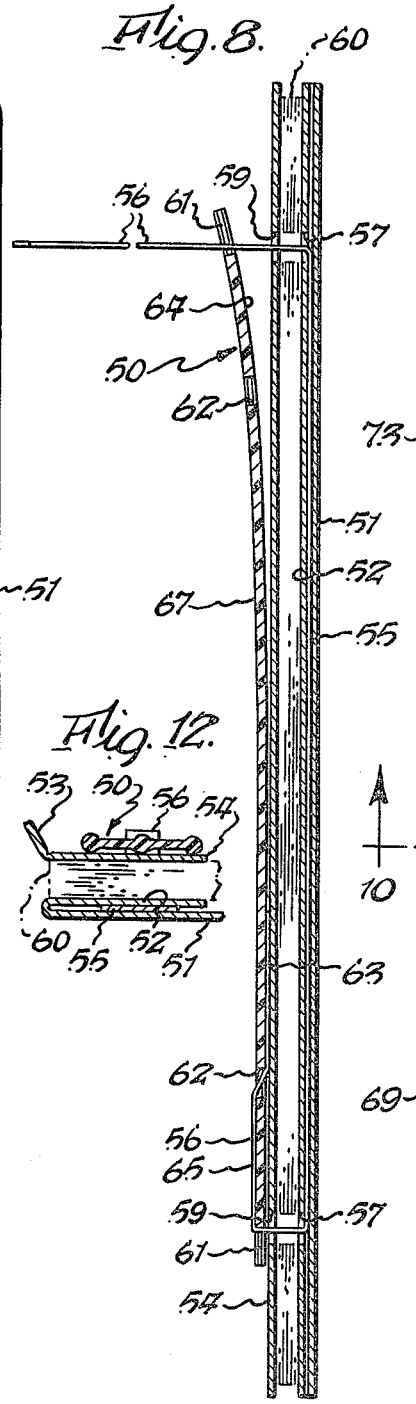
Fig. 9.
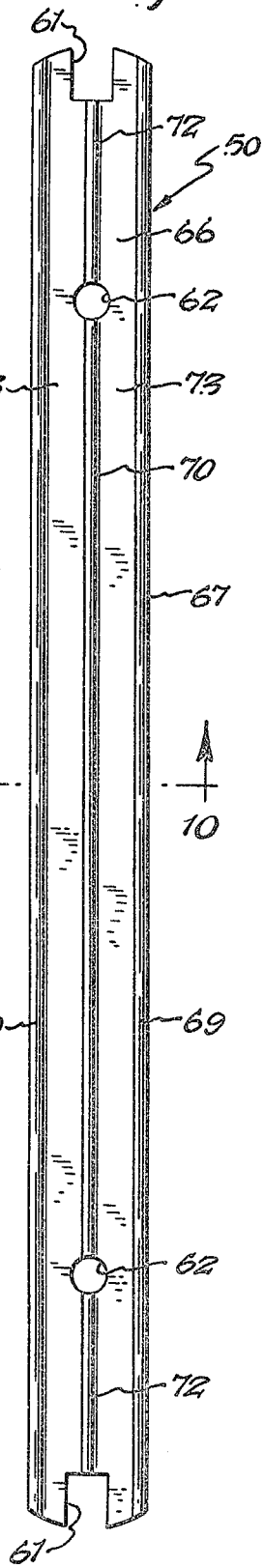
Fig. 12.
Fig. 10.
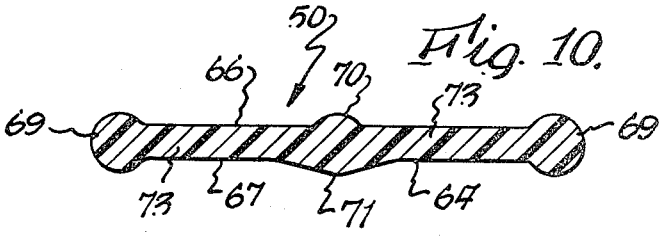

PAPER COMPRESSOR

CROSS REFERENCE TO RELATED APPLICATION

The present application is a continuation-in-part of application Ser. No. 94,037, filed Nov. 13, 1979 now abandoned.

BACKGROUND OF THE INVENTION

The present invention relates to an improved paper compressor of the type which is normally used with a fastener to retain papers in position in a file folder or the like.

By way of background, there are numerous types of paper compressors known and in common usage. These compressors are usually metal members which have various arrangements for securing the ends of prong members to retain a stack of papers in assembled relationship. These prior compressors are relatively expensive and/or bulky and/or difficult to use. Furthermore, many consist of more than one part so that they are relatively complicated.

SUMMARY OF THE INVENTION

It is an object of the present invention to provide an improved paper compressor which is extremely simple and which can be manufactured at a relatively low cost.

Another object of the present invention is to provide a plastic paper compressor which is relatively flexible and which can be manipulated during the process of assembling prong members therewith to enhance the ease with which the compressor is mounted.

A further object of the present invention is to provide an improved paper compressor which is formed so that it assumes a curved shape when it is unstressed, and when it is stressed in its assembled position, it provides a bias which tends to hold prongs of an associated fastener member in locked relationship therewith.

Yet another object of the present invention is to provide a highly simplified paper compressor which is relatively stable because of an unique rib structure which it possesses.

A still further object of the present invention is to provide an improved method for fabricating paper compressors. Other objects and attendant advantages of the present invention will readily be perceived hereafter.

The present invention relates to a paper compressor comprising an elongated body portion having a pair of opposite sides and a pair of opposite ends and a longitudinal axis, a hole spaced inwardly from each of said ends, said body portion including an upper surface and a lower surface and being curved so that the lower surface is convex.

The present invention also relates to an improved method for fabricating a paper compressor comprising steps of extruding a plastic ribbon-shaped member, passing said member over a roller to impart a curvature thereto, and punching holes into longitudinally spaced portions of said ribbon to define said paper compressor. The various aspects of the present invention will be more fully understood when the following portions of the specification are read in conjunction with the accompanying drawings wherein:

BRIEF DESCRIPTION OF THE DRAWINGS

FIG. 1 is a fragmentary plan view of an improved plastic paper compressor of the present invention mounted on a backing sheet and cooperating with a pronged paper fastener to hold a plurality of paper sheets in assembled relationship;

FIG. 2 is a fragmentary cross sectional view taken substantially along line 2—2 of FIG. 1;

FIG. 3 is a fragmentary cross sectional view similar to FIG. 2 but showing prongs of the paper fastener in unassembled relationship relative to the paper compressor and showing further the unstressed curvature of the paper compressor;

FIG. 4 is an enlarged plan view of the paper compressor;

FIG. 5 is a cross sectional view taken substantially along line 5—5 of FIG. 4;

FIG. 6 is a schematic view of the method of fabricating the paper compressor;

FIG. 7 is a fragmentary plan view of a modified form of paper compressor which is greatly elongated as compared to the compressor of FIGS. 1-5;

FIG. 8 is a fragmentary cross sectional view taken substantially along line 8—8 of FIG. 7 and showing the paper compressor with one end thereof engaged with the paper fastener prong while the other end thereof is in unfastened relationship, thereby indicating the natural curvature of the paper fastener;

FIG. 9 is an enlarged plan view of the paper fastener of FIGS. 7 and 8;

FIG. 10 is a cross sectional view taken substantially along line 10—10 of FIG. 9;

FIG. 11 is a diminutive perspective view of a file folder mounting the improved paper compressor of FIGS. 1-5 of the present invention;

FIG. 12 is a fragmentary cross sectional view taken substantially along line 12—12 of FIG. 7;

DESCRIPTION OF THE PREFERRED EMBODIMENTS

Figure 13:
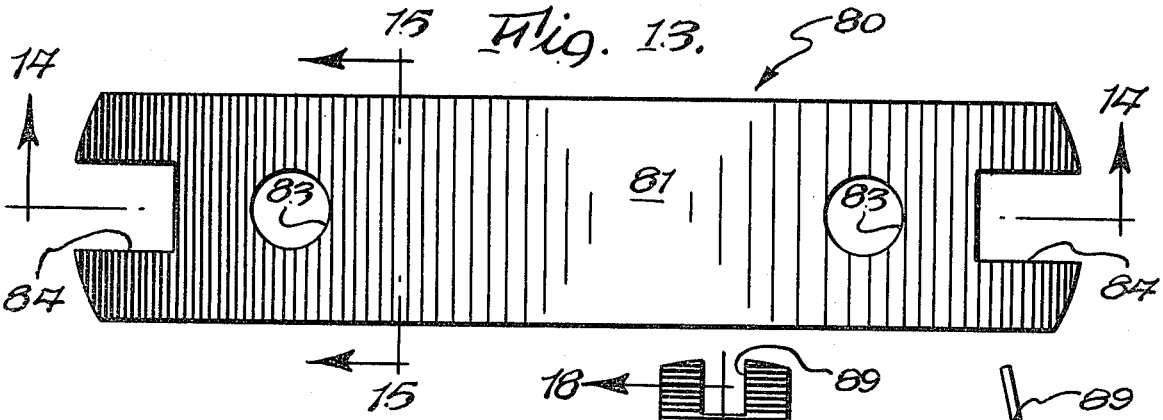
FIG. 13 is an enlarged plan view of a paper compressor which is made out of steel.

One embodiment of the improved compressor 10 of the present invention is shown in FIGS. 1-3 and 11 as being mounted on leaf 11 of a file folder 12 which consists of leaves 11 and 13 which are joined at fold 14. File folders of this type are normally used for storing papers which are placed in file cabinets. However, it will be understood that the improved compressor 10 of the present invention may be used with any type of base member which supports a pronged fastener, such as 15, which is suitably secured to the base member. Paper fastener 15 may be of the type specifically depicted in U.S. Pat. No. 3,741,385 which shows an overlay member, such as 16, which adhesively secures the central portion 17 of the fastener member to leaf 11 with the prongs 19 of the fastener member extending through apertures 20 in the overlay member. As is well understood in the art, a plurality of sheets of paper 21 having spaced holes 22 therein are mounted on the fastener member by inserting the prongs 19 through the holes 22.

When it is desired to fasten the stack of papers 21, the compressor 10 is placed on top of the uppermost sheet, as shown in FIG. 3, with the undersurface 23 pressing on the portion of the stack of papers between holes 22. Prongs 19 are received in slots 24 at the ends of body portion 25 of the compressor and thereafter the outer ends 26 of the prongs are threaded through holes 27 which are spaced inwardly on body portion 25 from slots 24. The portions 29 of prongs 19 which lie between slots 24 and apertures 27 lie on the upper surface 30 of compressor 10 and the outer ends 31 of prongs 19, after passing through holes 27, lie between the undersurface 23 of compressor 10 and the uppermost sheet of the stack of papers 21. By means of the locking action obtained by the foregoing arrangement, the compressor 10 holds the stack of papers in assembled relationship.

The improved compressor 10 is fabricated from polyvinyl chloride although any suitable plastic may be used. The body portion 25 has opposite ends 33 in which slots 24 are formed. The opposite sides 34 are formed into enlarged ribs, which are partially circular in cross section, as shown in FIG. 5. A rib 35 extends along the longitudinal axis of compressor 10 and extends up to holes 27. Short ribs 36 extend between holes 27 and edges 37 of slots 24. Ribs 35 and 36 have the contour shown in FIG. 5. In addition, the undersurface 32 of body portion 25 is enlarged in the form of a shallow rib as shown at 39 throughout the length of the compressor. The foregoing rib structure consisting of ribs 34, 35, 36 and 39 give stability to the compressor against distortion due to twisting. In a device which was actually made, the portions 40 between ribs 34 and 35 were 0.045 inches thick and the diameter of the circular portion of ribs 34 was 0.060 inches. In addition, the radius R was 11/16ths inches. The distance between the center of holes 27 was $1\frac{7}{8}$ inches. The remainder of fastener 10, as shown in FIGS. 4 and 5, is drawn to scale.

In its normal unstressed state, compressor 10 assumes the bowed configuration shown in FIG. 3 wherein the upper surface 30 is concave and the lower surface 23 is convex so that the center 41 bears on the paper stack. When the prongs 19 are threaded through holes 27 to assume the position shown in FIG. 2, the compressor 10 is forced into a straightened condition. This has a twofold result. Firstly, the central portion of the undersurface of the compressor bears downwardly on the paper stack 21 to provide firm engagement therewith. Secondly, a self-locking action is provided with portions 29 of prongs 19, to thereby resist loosening of the compressor. In the latter respect, because compressor 10 is stressed from the condition shown in FIG. 3 to the condition shown in FIG. 2, the end portions 42 of the compressor will bear upwardly against portions 29 of the prongs to provide a locking action.

It can be seen from FIGS. 1–3 that the end portions 42 of the compressor partially overlie holes 22 and that end prongs 32 extend outwardly beyond the holes 22. This geometry produces a better holding force on the stack of papers. In addition, the rectilinear slots 24 act as guides during the assembling of the prongs with the compressor. Furthermore, the compressor is flexible, and this enhances the ease of assembly with the prongs.

Broadly, the improved compressor 10 is made by the process schematically shown in FIG. 6 wherein a ribbon 43 of plastic of the cross sectional shape shown in FIG. 5 is extruded from extruding machine 44. After extrusion, the ribbon 43 passes over cool roller 45 so that the process of cooling the hot ribbon 43 causes it to assume the curvature shown at 46. Thereafter ribbon 43 passes through punching dies 47–48 which form end slots 24, holes 27, and the curved outer ends 49. It will be appreciated that the showing in FIG. 6 is highly schematic.

A modified version of the compressor 10 of FIG. 1 is shown at 50 in FIGS. 7–10 and 12. This compressor is much longer than that shown in the preceding figures and its primary use is as a compressor to extend lengthwise down the side of a sheet of paper, rather than being located at the top of the sheet, as shown in FIG. 1. In this respect, FIGS. 7, 8 and 12 show a folder having a backing leaf 51 having an edge portion 52 which is folded inwardly. The front leaf 53 also has an edge portion 54 which is folded inwardly. An elongated fastener member includes a central portion 55 which lies against one side of edge portion 52 and has prongs 56 which extend through holes 57 in edge portion 52. Prongs 56 also extend through holes 59 in edge portion 54. Papers to be held in the folder of FIGS. 7 and 8 are inserted by mounting them on prongs 56 after edge portion 54 is removed therefrom. Thereafter edge portion 54 is placed on a stack of papers 60 and prongs 56 are located in slots 61 and thereafter threaded through holes 62 to assume the position shown in FIGS. 7 and 8 wherein the ends 63 of the prongs 57 lie in continuous relationship to undersurface 64 while portions 65 of prongs 56 between slots 61 and holes 62 lie against the upper surface 66 of compressor 50. The body portion 67 of compressor 50 has a natural curvature wherein undersurface 64 is convex and upper surface 66 is concave, as described above relative to the embodiment of FIGS. 1–5. Edge ribs 69 are formed on the outer edges of body portion 67 and central ribs 70 and 71 are formed along the longitudinal axis of the body portion. Ribs 72, which are of the same contour as ribs 70, extend on the upper surface between holes 62 and slots 61, and ribs of the same contour as rib 71 also extend between holes 62 and slots 61 on the undersurface.

By way of example, compressor 50 has the following dimensions. The thickness of body portions 73 between ribs 70 and 69 is 0.045 inches. However, ribs 69 have a diameter of 0.065 inches. The distance between the centers of holes 62 is $6\frac{1}{8}$ inches and the length of ribs 72 is $1\frac{1}{4}$ inches. The remainder of the compressor 50 is drawn to scale. It is to be especially noted that the diameter of ribs 69 of FIG. 9 is greater than the diameter of ribs 34 of FIG. 4 because the compressor of FIG. 9 is longer. This is necessary to maintain the stability of the longer compressor.

It will be appreciated that the only substantial difference between the compressor of FIGS. 1–5 and the compressor of FIGS. 7–10 is in the length and slightly in the dimensions but that they both operate in the same manner, especially insofar as the locking effect of the end portions on the prongs of the fastener. In addition, in view of the fact that the compressor is curved, the center will tend to bear downwardly on the stack of papers against which it is placed.

Figure 14:
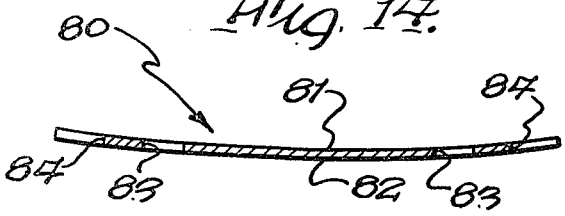
FIG. 14 is a reduced cross sectional view taken substantially along line 14—14 of FIG. 13.
Figure 15:
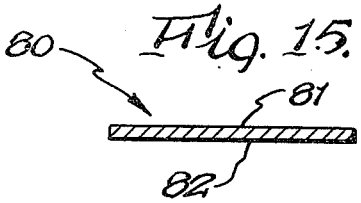
FIG. 15 is a cross sectional view taken substantially along line 15—15 of FIG. 13.

In FIGS. 13–15 a further embodiment of the present invention is disclosed. In this embodiment the compressor 80 is fabricated from steel and, as shown in FIG. 14, it assumes a curved shape, because of its inherent springiness, which causes its upper surface 81 to be concave and its lower surface 82 to be convex in a direction along its longitudinal axis. However, as can be seen from FIG. 15, it is straight across its width. The compressor 80 includes a pair of spaced holes 83 which are analogous to spaced holes 27 of the embodiment shown in FIG. 4. It also includes a pair of spaced slots 84 which are analogous to spaced slots 24 of the embodiment of FIG. 4. The only differences between the embodiment of FIGS. 13–15 and the embodiment of FIGS. 1–5 is that the embodiment of FIGS. 13–15 is made out of steel, or any other resilient metal and further that the embodiment of FIGS. 13–15 does not have ribs. It is substantially planar, except for the curvature described above. The embodiment of FIGS. 13–15 has all of the advantages of the embodiment of FIGS. 1–5 and operates in the same manner and has the same relative location of the holes and slots with respect to the holes in the paper which it compresses.

Figure 17:
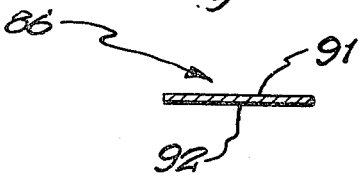
FIG. 17 is a cross sectional view taken substantially along line 17—17 of FIG. 16.
Figure 16:
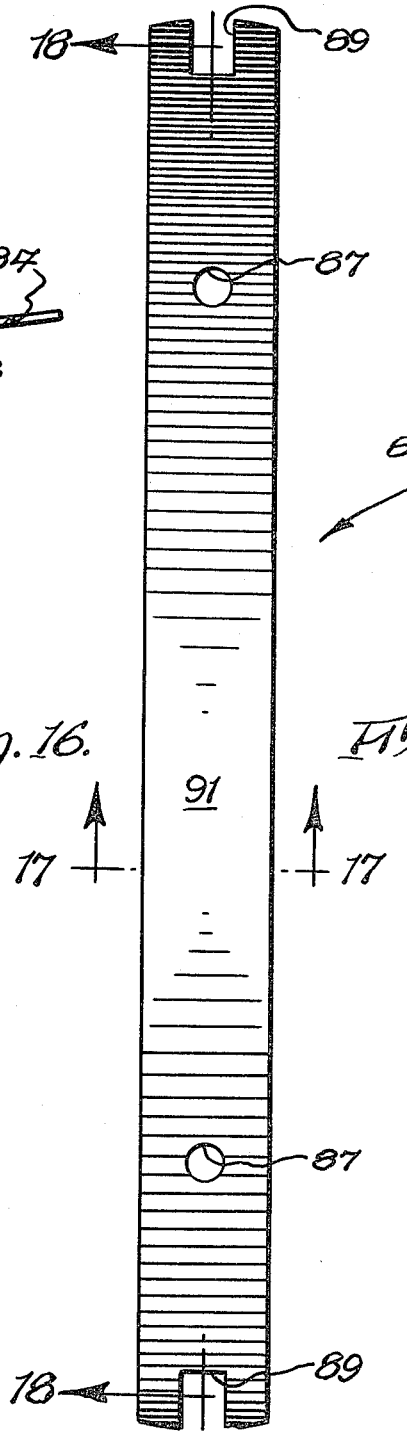
FIG. 16 is a plan view of a modified form of steel paper compressor which is greatly elongated as compared to the compressor of FIGS. 13-15.
Figure 18:
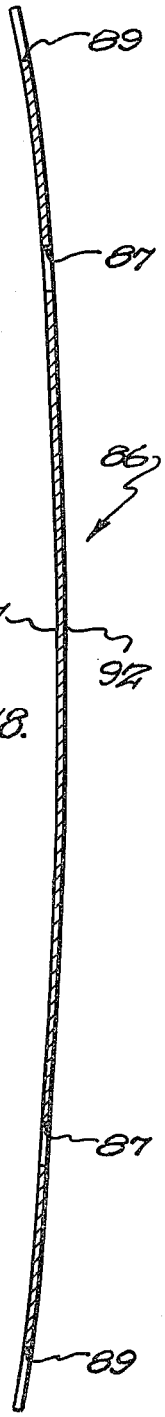
FIG. 18 is a cross sectional view taken substantially along line 18—18 of FIG. 16.

In FIGS. 16–18 a further embodiment of the invention is disclosed which is analogous to the embodiment of FIGS. 7–10, except that the embodiment of FIGS. 16–18 is fabricated from steel, or other suitable material, and does not have the molded ribs of FIGS. 7–10. The compressor 86 of FIGS. 16–18 is fabricated from a strip of steel and it has a pair of spaced holes 87 which are analogous to spaced holes 62 of the embodiment of FIGS. 7–10. It also has a pair of spaced slots 89 which are analogous to spaced slots 61 of the embodiment of FIGS. 7–10. The upper surface 91 of compressor 86 is concave and the lower surface 92 is convex. Across its width the compressor is substantially straight at any cross sectional area. The compressor of FIGS. 16–18 operates in the same manner as the embodiment of FIGS. 7–10, as fully described above.

The advantage of the embodiments of FIGS. 13–18 over the plastic embodiments is in the fact that they are easier and cheaper to fabricate. However, all of the embodiments, because of their curvature along their longitudinal axes will provide the mode of operation and advantages set forth above relative to the plastic embodiments. It will be appreciated that the embodiments of FIGS. 13–18 can be made out of any material which is sufficiently strong to provide the desired results without the use of the ribs of the embodiments of FIGS. 1–12.

It can thus be seen that the improved compressor of the present invention is manifestly capable of achieving the above enumerated objects, and while preferred embodiments have been disclosed, it will be appreciated that the present invention is not limited thereto, but may be otherwise embodied within the scope of the following claims.

What is claimed is:

1. A paper compressor comprising an elongated plastic body portion having a pair of opposite sides and a pair of opposite ends and a longitudinal axis, a hole spaced inwardly from each of said ends, and rib means molded integrally with said plastic body portion and extending longitudinally of said body portion, said body portion including an upper surface and a lower surface, and said body portion being curved so that said lower surface is convex.

2. A paper compressor as set forth in claim 1 including a slot spaced outwardly of each of said holes and extending inwardly from each of said ends.

3. A paper compressor as set forth in claim 2 wherein said rib means comprise a pair of ribs extending along said opposite sides.

4. A paper compressor as set forth in claim 1 including an additional rib molded integrally with said plastic body portion and extending along said longitudinal axis.

5. A paper compressor as set forth in claim 2 wherein said slots and said holes are located on said longitudinal axis.

6. A paper compressor as set forth in claim 5 wherein said additional rib extends between said holes and between said slots and said holes.

7. A paper compressor as set forth in claim 1 wherein each of said slots is dimensioned so that a portion of said body portion adjacent thereto overlies a hole in paper which underlies said compressor.

8. A paper compressor comprising an elongated plastic body portion having a pair of opposite sides and a pair of opposite ends and a longitudinal axis, a hole spaced inwardly from each of said ends, rib means molded integrally with said plastic body portion and extending longitudinally of said longitudinal axis, upper and lower surfaces on said body portion, said body portion being resiliently biased so that said upper surface assumes a concave condition between said ends and said lower surface assumes a convex condition between said ends.

9. A paper compressor as set forth in claim 8 including a slot located outwardly of each of said holes.

10. A paper compressor comprising an elongated strip-like body portion having a pair of opposite sides and a pair of opposite ends and a longitudinal axis, a hole spaced inwardly from each of said ends, said body portion including an upper surface and a lower surface, and said body portion being curved so that said lower surface is convex.

11. A paper compressor as set forth in claim 10 including a slot spaced outwardly of each of said holes and extending inwardly from each of said ends.

12. A paper compressor as set forth in claim 11 wherein said slots and said holes are located on said longitudinal axis.

13. A paper compressor as set forth in claim 11 wherein each of said slots is dimensioned so that a portion of said body portion adjacent thereto overlies a hole in paper which underlies said compressor.

14. A paper compressor comprising an elongated strip-like body portion having a pair of opposite sides and a pair of opposite ends and a longitudinal axis, a hole spaced inwardly from each of said ends, upper and lower surfaces on said body portion, said body portion being resiliently biased so that said upper surface assumes a concave condition between said ends and said lower surface assumes a convex condition between said ends.

15. A paper compressor as set forth in claim 14 including a slot located outwardly of each of said holes.

* * * * *